US007293508B2

(12) United States Patent
Johnson et al.

(10) Patent No.: US 7,293,508 B2
(45) Date of Patent: Nov. 13, 2007

(54) PALLET RAMP WITH SAFETY RETAINER

(75) Inventors: Kevin Duane Johnson, Cary, NC (US); Ivan Neil Liverman, Middlesex, NC (US); Eric Allen Stegner, Durham, NC (US); Robert William Stegner, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 182 days.

(21) Appl. No.: 11/157,261

(22) Filed: Jun. 21, 2005

(65) Prior Publication Data

US 2006/0283359 A1 Dec. 21, 2006

(51) Int. Cl.
*B65D 19/00* (2006.01)

(52) U.S. Cl. ..... 108/55.1; 108/51.11

(58) Field of Classification Search ..... 108/55.1, 108/51.11; 206/386, 59.5, 600; 410/6, 499; 249/346.3, 346.1; 414/536, 228; 248/346.02
See application file for complete search history.

(56) References Cited

U.S. PATENT DOCUMENTS 3,476,060 A * 11/1969 Sjoblom ..... 108/55.1
4,309,013 A * 1/1982 Howe et al. ..... 108/55.1
4,314,686 A * 2/1982 Marz ..... 108/55.1
4,319,732 A * 3/1982 Godfrey ..... 108/55.1
4,537,540 A * 8/1985 Boughton ..... 108/55.1
4,638,744 A * 1/1987 Clive-Smith ..... 108/55.1
4,964,349 A * 10/1990 Bishop ..... 108/55.1
5,505,140 A 4/1996 Wittmann
5,579,700 A 12/1996 Nuechterlein et al.
5,644,992 A * 7/1997 Clive-Smith ..... 108/55.1
5,676,065 A * 10/1997 Locker ..... 108/55.1
5,810,186 A * 9/1998 Lam ..... 108/55.1
5,911,179 A 6/1999 Spiczka
6,210,089 B1 4/2001 Rinehart
6,349,656 B1 2/2002 Mitchell
6,539,881 B2 4/2003 Underbrink et al.
6,769,368 B2 8/2004 Underbrink et al.
6,866,160 B2 * 3/2005 Wang et al. ..... 108/55.1

* cited by examiner

*Primary Examiner*—José V. Chen
(74) *Attorney, Agent, or Firm*—Gregory M. Doudnikoff; Dillon & Yudell LLP

(57) ABSTRACT

A method and system is presented for ensuring that a latch securing a ramp to a pallet is properly aligned and seated before a product can be offloaded from the pallet and down the ramp. The system uses a latching system that has a pallet-attached base and a ramp-attached mating bracket. The pallet-attached base has two rods. The first rod has a retainer arm that is restricted by the second rod to a vertical position, thus preventing a shipment on the pallet from reaching the ramp. The second rod has a thin portion and a thick portion. The second rod must be laterally moved such that the mating bracket mates only with the thin portion of the rod. This lateral movement moves the second rod away from the first rod's retainer arm, thus allowing the retainer arm to fold down.

18 Claims, 7 Drawing Sheets

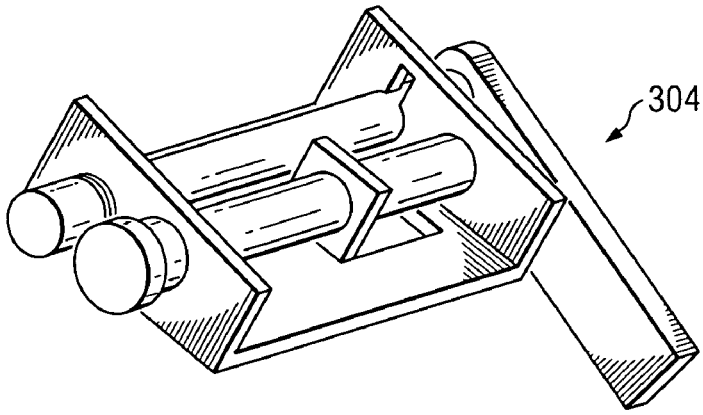
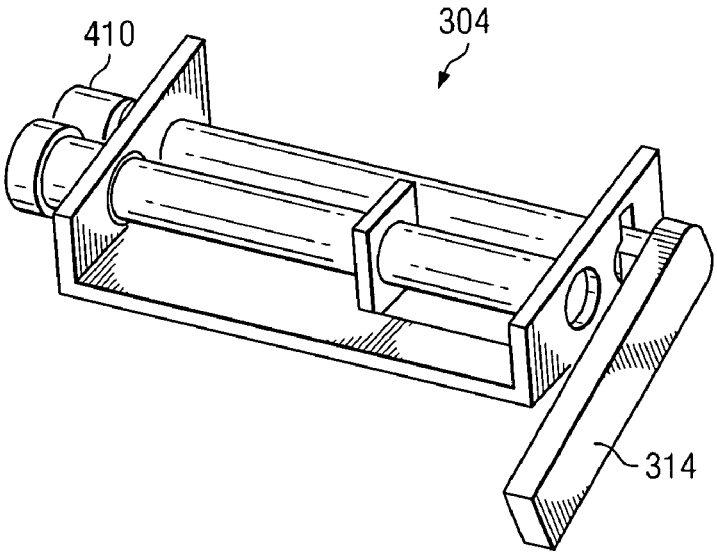
FIG. 4d
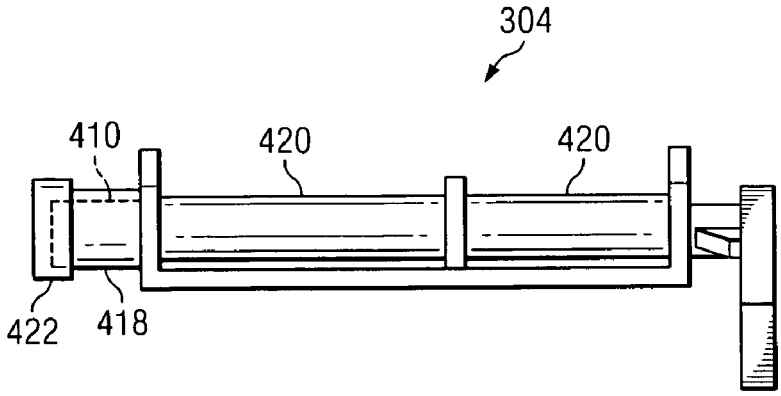

PALLET RAMP WITH SAFETY RETAINER

BACKGROUND OF THE INVENTION

1. Technical Field

The present invention relates in general to the field of shipment packaging, and in particular to pallets. Still more particularly, the present invention relates to a pallet ramp used to unload a product that has been shipped on a pallet, and incorporates the use of a safety retainer that prevents the product from being unloaded from the pallet unless the pallet ramp is properly positioned with and secured to the pallet.

2. Description of the Related Art

Large and heavy products, such as computer servers, are typically shipped to a customer on a pallet. Upon delivery, the shipment must be manually offloaded from the pallet. To prevent jarring and damage to the product caused by the product being dropped off the edge of the pallet, which is typically several inches high, the shipment is slid off the pallet using a ramp. Consider, for example, the arrangement shown in FIG. 1*a*. A shipment 102 is shipped to a customer's site on a pallet 104, which is set on the ground 106. To avoid jarring damage that could result from simply sliding the shipment 102 off the right side of the pallet 104, a ramp 108 is secured by a latch 110 to the pallet 104, providing a slide on which the shipment 102 can be moved to the ground 106.

The system shown in FIG. 1*a* works fine as long as latch 110 securely attaches ramp 108 to pallet 104. However, assume that ramp 108 and pallet 104 are not properly aligned, resulting in latch 110 not being properly aligned. The result is shown in FIG. 1*b*, which depicts the end result of ramp 108 falling to the ground 106 while supporting the load of shipment 102. Shipment 102 has thus fallen to the ground 106 from a distance that is the height of pallet 104. If shipment 102 is a fragile product, such as a populated computer server chassis, the fall likely caused expensive, if not irreparable, damage to shipment 102.

SUMMARY OF THE INVENTION

In response to the shortcomings of the prior art system described, the present invention is thus directed to a method and system for ensuring that a latch securing a ramp to a pallet is properly aligned and seated before a product can be offloaded from the pallet and down the ramp. The system uses a novel latching system that has a base and a mating bracket. The base is attached to the pallet, and the mating bracket is attached to the ramp. The base has two rods. The first rod has a retainer arm that is restricted by the second rod to a vertical position, thus preventing a shipment on the pallet from reaching the ramp. The second rod has a thin portion and a thick portion. The second rod must be laterally moved such that the mating bracket mates only with the thin portion of the rod. This lateral movement moves the second rod away from the first rod's retainer arm, allowing the retainer arm to fold down, and thus allowing the shipment to slide down the ramp.

The above, as well as additional purposes, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

FIG. 4*d* depicts, using two oblique and one side view of the base, the retaining arm in a folded down unrestricting position, such as shown in FIG. 3*c*.

DETAILED DESCRIPTION OF THE PREFERRED EMBODIMENT

Figure 1A:
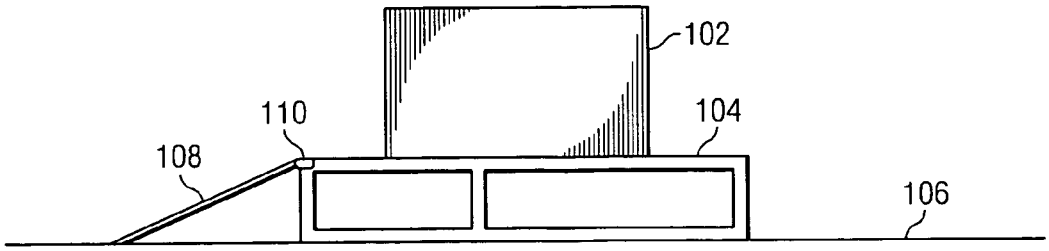
FIG. 1a (PRIOR ART)
FIGS. 1*a-b* depict a prior art pallet and ramp system that is susceptible to latching failure due to misalignment of the pallet and ramp.
Figure 1B:
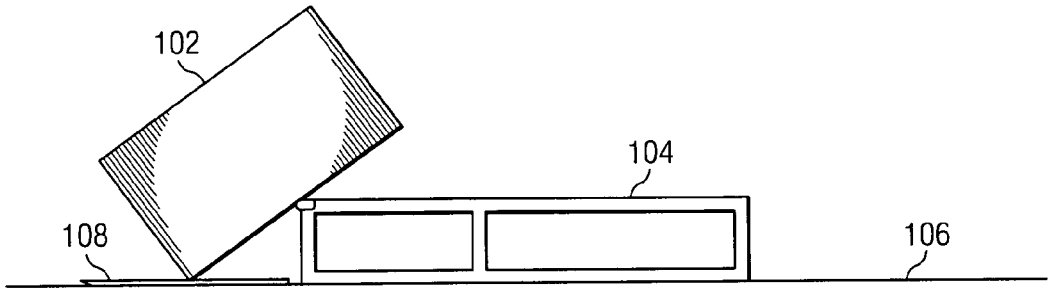
FIG. 1b (PRIOR ART)
Figure 2:
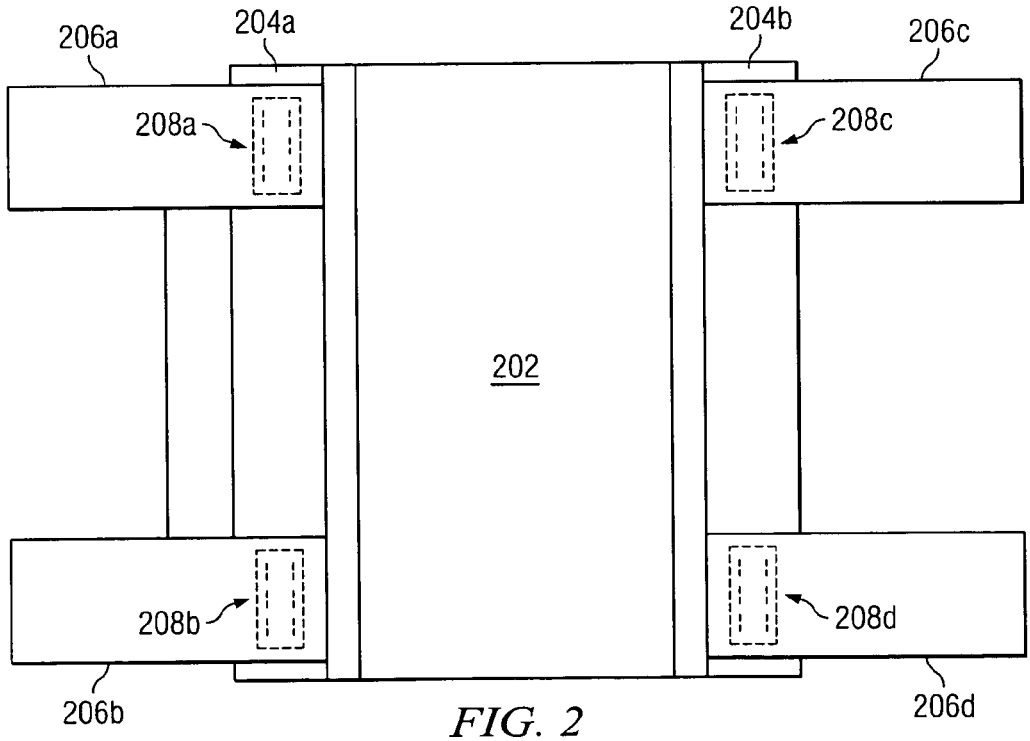
FIG. 2 illustrates a pallet and multiple ramp configuration as used in a preferred embodiment of the present invention.

With reference now to FIG. 2, a top view of a pallet 202 is shown having beveled edges 204*a-b* at each end of pallet 202. Four ramps 206*a-d* are attached to respective beveled edges 204*a-b* using latching systems 208*a-d*. The ramps 206*a-d* reach the ground 302 as shown below in the partial side view of pallet 202 depicted FIG. 3*c*.

Figure 3A:
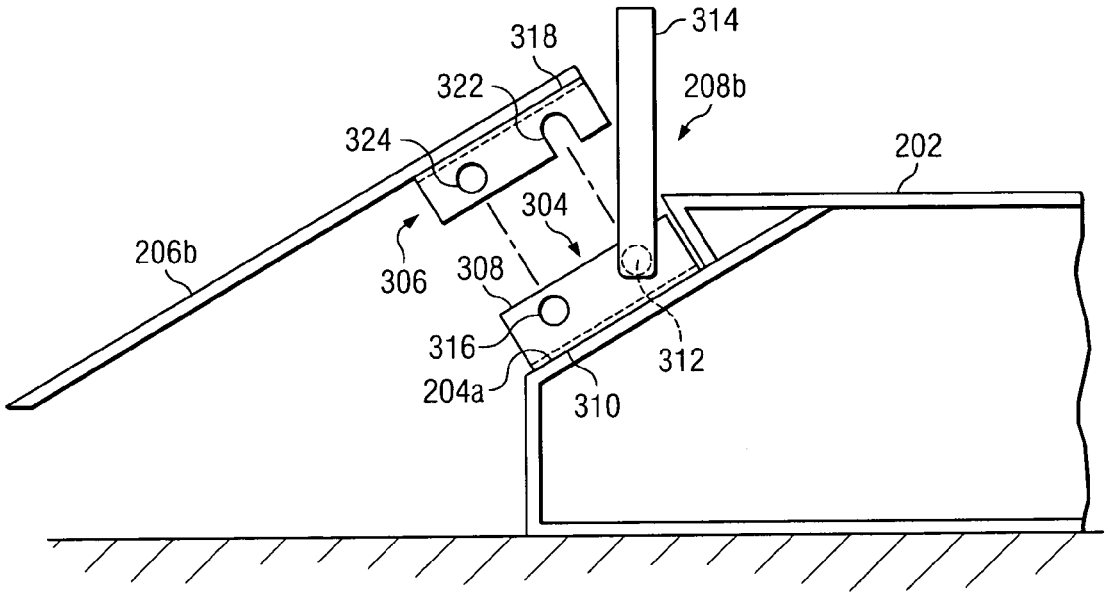
FIG. 3*a* depicts the inventive latching system before a base and mating bracket are mated.

Referring now to FIG. 3*a*, a side view of pallet 202 and ramp 206*b* (which is representative of each of the ramps 206*a-d*) shows additional detail of latching system 208*b*. Latching system 208*b*, which is representative of each of the latching systems 208*a-d* shown in FIG. 2, includes a base 304 and a mating bracket 306.

Base 304 includes a base bracket 308, which has a first base plate 310 that is directly attached to the upper surface of beveled edge 204*a*. Base 304 also has a first rod 312, which is attached to a retainer arm 314, and a second rod 316, whose function is described in further detail below. Although first rod 312 and second rod 316 are depicted as cylindrical rods, it should be understood that their shape is not limited to cylindrical rods, but rather any rod having a geometry that permits first rod 312 to rotate as described below.

Figure 3B:
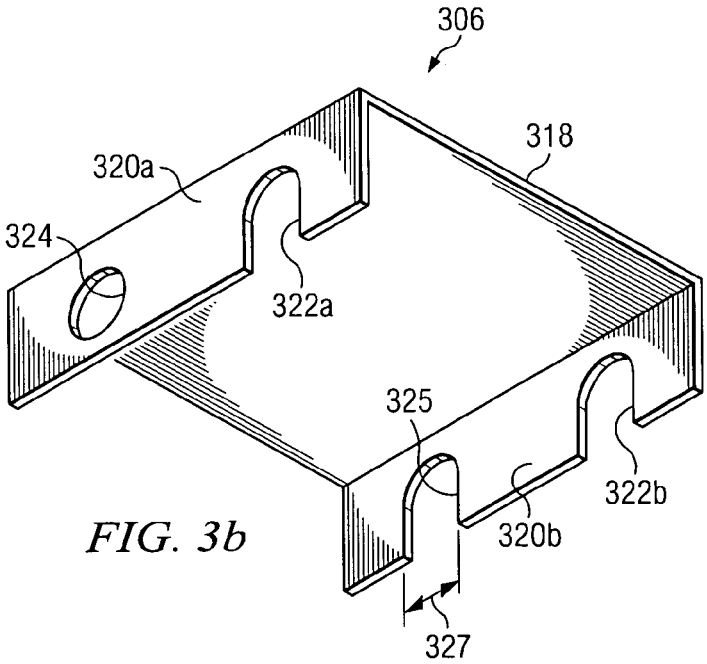
FIG. 3*b* illustrates additional detail of the mating bracket.
Figure 3C:
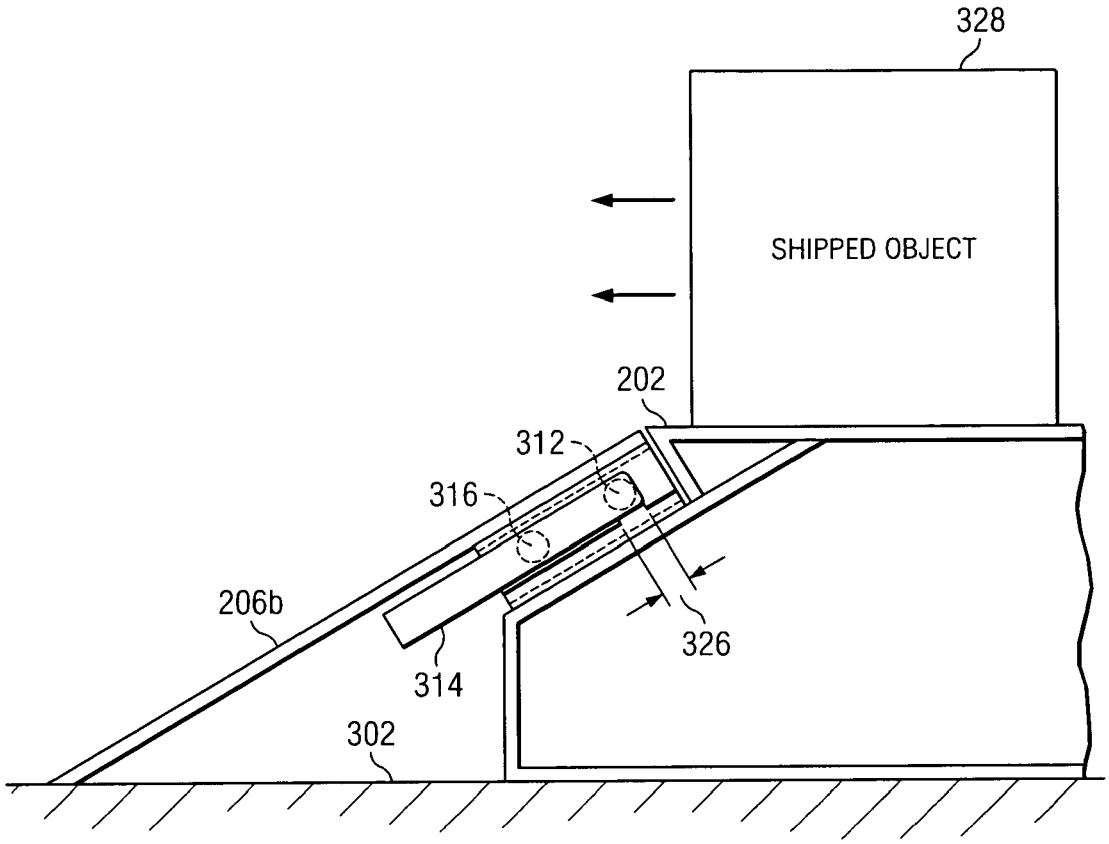
FIG. 3*c* depicts the latching system shown in FIG. 3*a* in a mated position.

Mating bracket 306 has a second base plate 318 that is directly attached to the lower surface of ramp 206*b*. As shown in greater detail in FIG. 3*b*, mating bracket has a first slot plate 320*a* and a second slot plate 320*b* attached to second base plate 318. First slot plate 320*a* has a first slot 322*a* and a side hole 324. Second slot plate 320*b* has a first slot 322*b* and a second slot 325. As shown in FIG. 3*c*, first slots 322*a-b* have a first throat width 326. As shown in FIG. 3*b*, second slot 325 has a second throat width 327. While first throat width 326 and second throat width 327 may be the same size or different sizes, note that first throat width 326 is wide enough to allow first slots 322 to mate with first rod 312, and second throat width 327 is wide enough to allow second slot 325 to mate with only a thin portion (discussed below) of second rod 316.

As shown in FIG. 3*c*, and as described in greater detail below, when second rod 316 is laterally slid within base 304 as described below, it no longer is able to block the rotation of retainer arm 314, which is thus able to fold downward, allowing a shipped object 328 on top of the pallet 202 to slide down ramps 206*a-b* shown in FIG. 2.

Figure 4A:
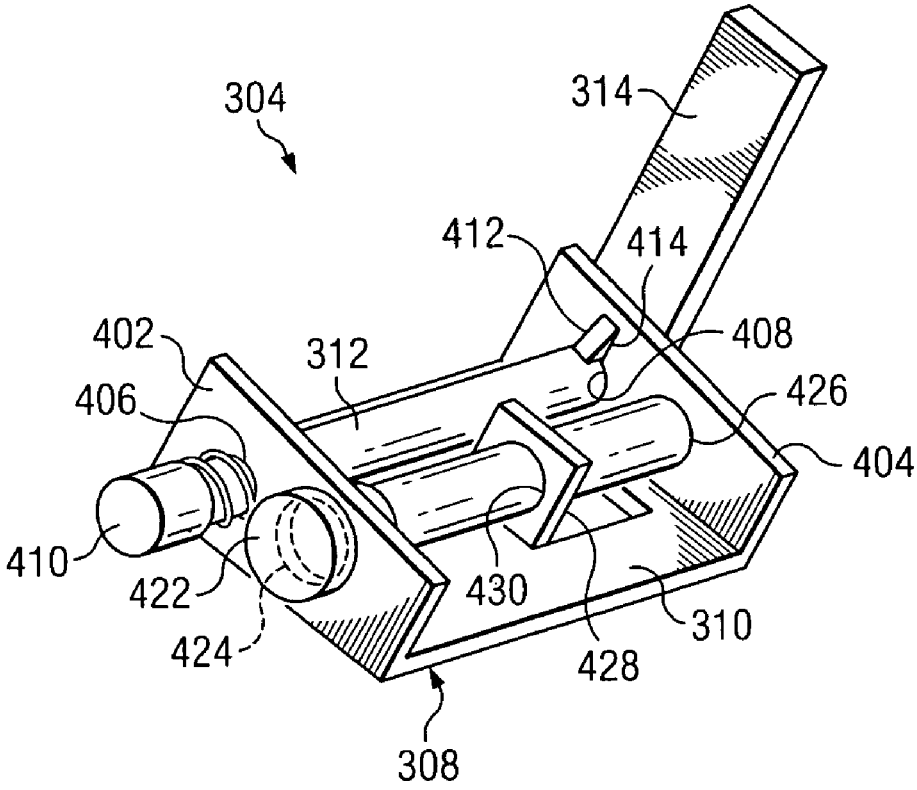
FIG. 4*a* illustrates, using two oblique views, additional detail of the base in which a retainer arm on a first rod is in a locked upright position by a second rod, thus preventing a shipment on the pallet from moving past the retaining arm.
Figure 4A:
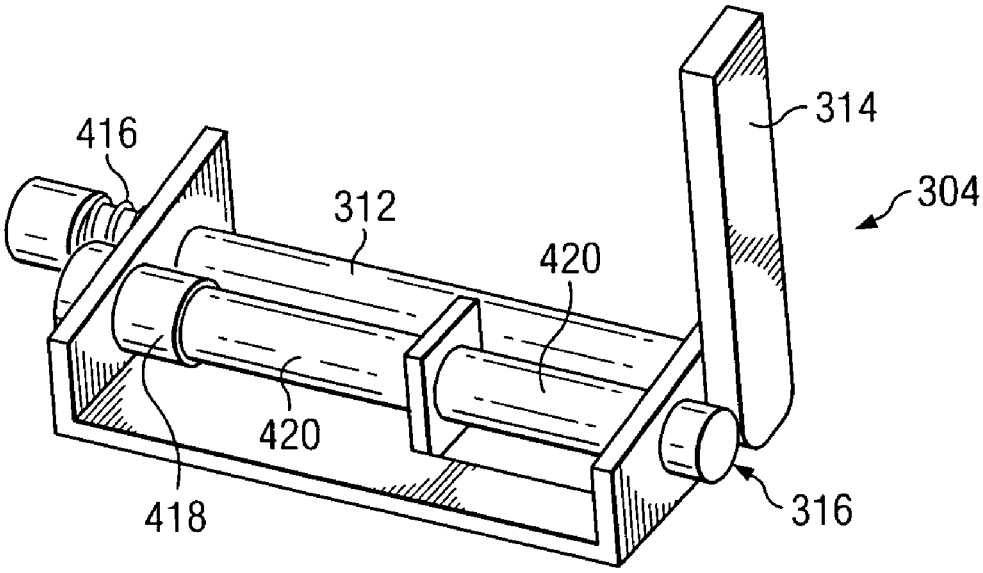

With reference now to FIG. 4*a*, additional detail is shown for base 304. Note that for clarity's sake, pallet 202's beveled edge 204, to which base 304 is attached, is not shown, nor is ramp 206 and it's mating bracket 306. Recall also that mating bracket 306 and base 304 together make up latching system 208.

Base bracket 308 has a first side plate 402 and a second side plate 404 that extend away, preferably perpendicularly, from first base plate 310. A first end of first rod 312 extends through a first hole 406, and the second end of first rod 312, to which retainer arm 314 is attached, extends through a second hole 408. To keep first rod 312 from sliding past first hole 406, a first rod travel limiter 410 is part of the first end of first rod 312. First rod travel limiter 410 may be a collar as depicted, or may be any protrusion or projection of or from first rod 312 that limits the lateral movement of first rod 312 past first hole 406. Note, however, that adequate space is provided between first rod travel limiter 410 and the exterior face of first side plate 402 to permit first rod 312 to move laterally to allow a retainer arm restrictor 412 to move clear of a restrictor slot 414, as shown below in FIG. 4*c*. Preferably, a first rod lock forcer 416, which is preferably a spring as shown, keeps retainer arm restrictor 412 within restrictor slot 414 by providing a force between first rod travel limiter 410 and the exterior face of first side plate 402. Alternatively, first rod lock forcer 416 may be a system of magnets, bands, other springs, or any other means for providing a lateral force to keep retainer arm restrictor 412 within restrictor slot 414, thus preventing first rod 312 from rotating and thus preventing retainer arm 314 from folding down.

Second rod 316 has a thick rod portion 418 and a thin rod portion 420. Thin rod portion 420 has a diameter that is small enough to pass through side hole 324 and to mate with second slot 325 of mating bracket 306 (shown in FIG. 3*b*), while thick rod portion 418 is too thick to pass through the second throat width 327 to mate with second slot 325 (all shown in FIGS. 3*b-c*). The only way for mating bracket 306, including second slot 325 and side hole 324, to mate with base 304 is to slide second rod 316 in the direction of knob 422, thus moving the thick rod portion 418 out of the way, allowing the thin rod portion 420 to mate into the second slot 325. Note that, as shown in FIG. 3*b*, first slot plate 320*a* has a side hole 324 through which second rod 316 slides (thus ensuring that base 304 and mating bracket 306 are secured together, alternatively side hole 324 may be replaced with a slot, which allows mating bracket 306 to simply mate and rest on top of first rod 312 and second rod 316 when second rod 316 is properly laterally positioned as described herein.

Knob 422 serves as a convenient hold to pull second rod 316 to the side. In addition, in a preferred embodiment knob 422 is magnetized, thus keeping knob 422 against first side plate 402 until the ramp 206 (with its mating bracket 306) is properly aligned with base 304, and second rod 316 can be pulled to the side as described herein. Alternatively, any system of springs, counterweights, or other means for temporarily keeping knob 422 positioned against first side plate 402 may be used.

Note that thick rod portion 418 slides through a thick third hole 424 in first side plate 402, while thin rod portion 420 slides through a thinner fourth hole 426 in second side plate 404. Note also that second rod 316 is aligned to slide into fourth hole 426 by an alignment bracket 428 having a fifth hole 430, preferably for aligning the thin rod portion 420 as shown.

Figure 4B:
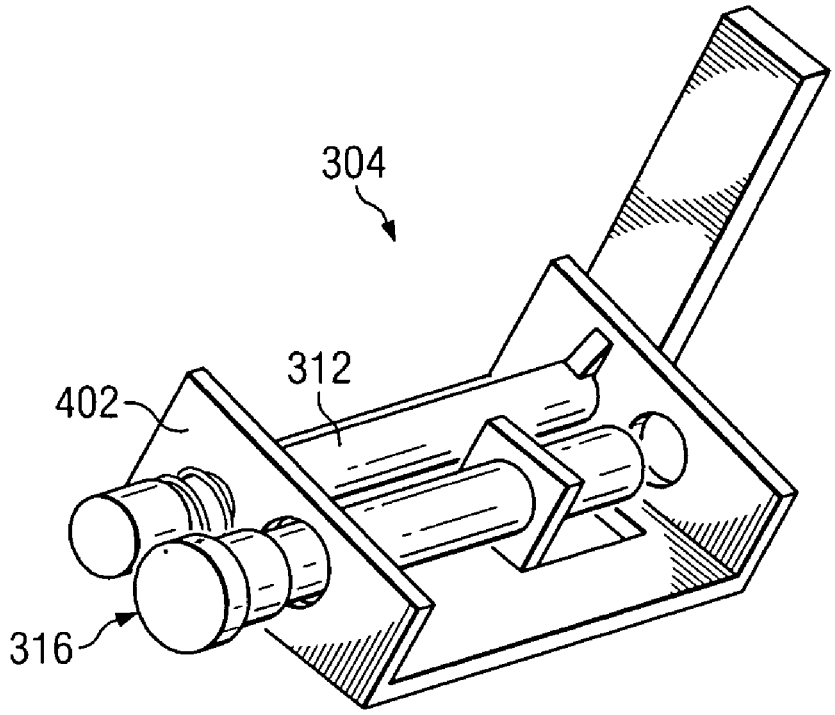
FIG. 4*b* depicts, using two oblique views, the base with the second rod moved laterally away from the retaining arm, such that the second rod no longer prevents the retaining arm from folding down.
Figure 4B:
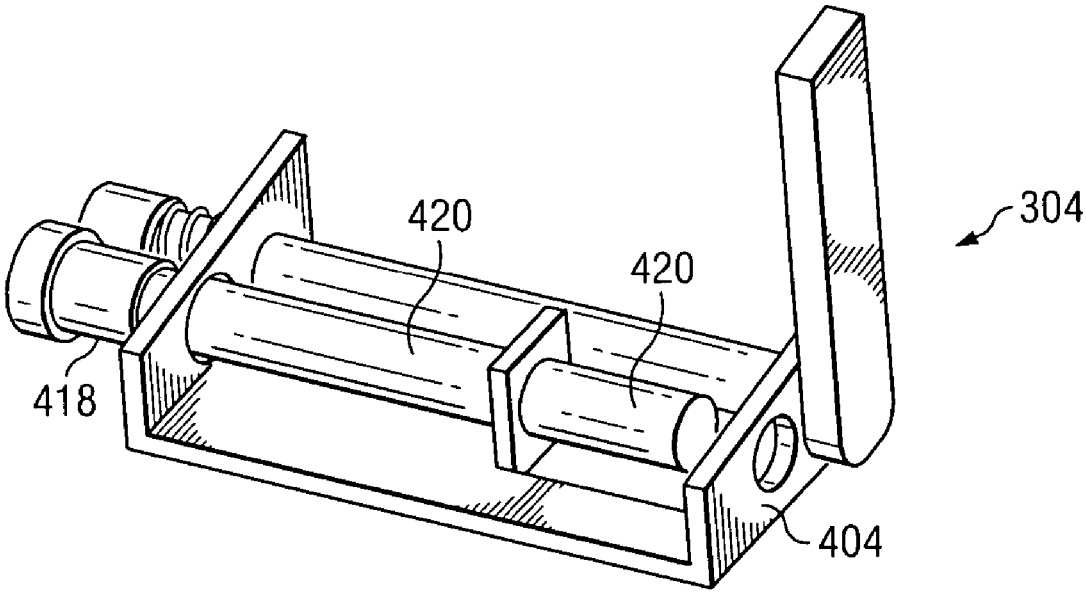

FIG. 4*a* thus depicts base 304 in a double-locked position, in which retainer arm 314 is prevented from folding down by both retainer arm restrictor 412 as well as by second rod 316 protruding past second side plate 404. Referring now to FIG. 4*b*, base 304 is depicted with second rod 316 having been pulled to one side such that the thick rod portion 418 is no longer between first side plate 402 and second side plate 404. In this position, mating bracket 306 (not shown) is able to mate its second slots 324 with thin rod portion 420 and its first slots 322 with first rod 312. By feeling this mating between mating bracket 306 and base 304 during the manual positioning of the ramp 206, including the insertion of thin rod portion 420 through side hole 324 of the mating bracket 306, the user is assured that ramp 206 is properly aligned with pallet 202 and its base 304. Note also that second rod 316 is no longer outside second side plate 404, and thus second rod 316 no longer poses an impediment to a downward travel of retainer arm 314.

Figure 4C:
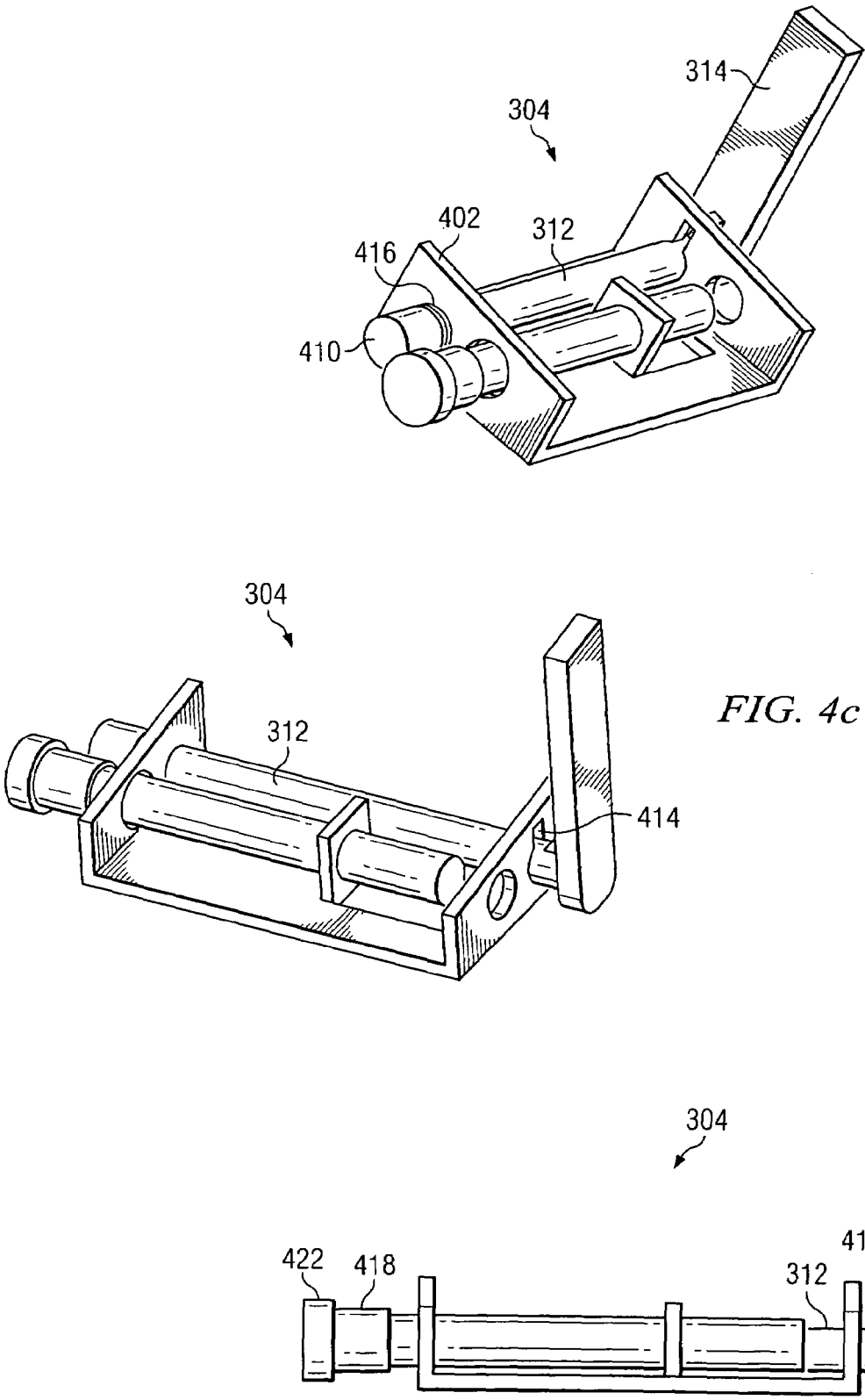
FIG. 4*c* illustrates, using two oblique and one side view of the base, the retaining arm in the base as being unrestricted by a chamfer that has been moved out of a restrictor slot.

With reference now to FIG. 4*c*, assume that ramp 206 and mating bracket 306 (neither shown) are properly mated with base 304. First rod 312 is then pushed to the side until first rod travel limiter 410 hits against the first side plate 402, freeing retainer arm restrictor 412 from restrictor slot 414. First rod 312 is now free to rotate, allowing retainer arm 314 to fold downward, as shown in FIG. 4*d* and FIG. 3*c*. Since retainer arm 314 is no longer sticking upwards, object 330 is now free to slide towards and down ramp 206.

The present invention is thus a great safety improvement. Shipped objects are not able to be slid off a pallet until the retainer arms are folded down, which can only occur when ramps are properly secured to the pallet.

While the invention has been particularly shown and described with reference to a preferred embodiment, it will be understood by those skilled in the art that various changes in form and detail may be made therein without departing from the spirit and scope of the invention.

What is claimed is:

1. A latching system comprising:

a base composed of:

a base bracket composed of:

a first base plate;

a first side plate and a second side plate extending away from the first base plate, the first side plate having a first hole and a second hole, and the second side plate having a third hole and a fourth hole;

a first rod that includes:

a retainer arm extending non-linearly away from the first rod, the first rod rotatably extending through the first hole in the first side plate of the bracket and the third hole in the second side plate of the base bracket, and the retainer arm being oriented by an external surface of the second side plate of the base bracket;

a second rod that includes:

a thin rod portion that has a first diameter;

a thick rod portion that is linear with the thin rod portion, the thick rod portion having a second diameter that is greater than the first diameter of the thin rod portion, wherein the thin rod portion is extensible through the fourth hole in the second side plate, and the thick rod portion is extensible through the second hole of the first side plate; and a knob that is attached to the thick rod portion of the second rod; and a mating bracket composed of:

a second base plate;

a first slot plate and a second slot plate extending away from the second base plate, the first and second slot plates each having a first slot, the second slot plate having a second slot, wherein the first slot has a first slot width and the second slot has a second slot width;

wherein the first slots each have a first throat width that is wide enough to permit the first rod to mate with the first slots, and wherein the second slot has a second throat width that is narrow enough to permit only the thin rod portion of the second rod to mate with the second slot in the mating bracket while preventing the thick rod portion from mating with the second slot in the mating bracket.

2. The latching system of claim 1, wherein if the second rod's thick rod portion is oriented with the second slot of the second slot plate of the mating bracket in an orientation that prevents the second rod's thick rod portion from mating with the second slot of the second slot plate of the mating bracket, then the second rod's thin rod portion extends past the exterior surface of the base bracket's second side plate, wherein the retainer arm of the first rod is prevented from rotating past the second rod's thin rod portion.

3. The latching system of claim 2, further comprising:

a second rod lock forcer that forces the second rod to be in a non-aligned position away from an exterior surface of the base bracket's first side plate, such that the second slot is unable to mate with the second rod and the retainer arm is prevented from rotating past the second rod's thin rod portion.

4. The latching system of claim 3, further comprising:

a first rod travel limiter on a first end of the first rod that is opposite a second end to which the retainer arm is attached, the first rod travel limiter being oriented against an exterior side of the first side plate of the base and the first rod travel limiter having a greater diameter than the first hole in the first side plate of the bracket, wherein the first rod is prevented from sliding through the third hole in the second side plate to a distance that permits the retainer arm to rotate past the thin rod portion when the second rod is in the non-aligned portion.

5. The latching system of claim 4, further comprising:

a retainer arm restrictor attached to the retainer arm and the first rod;

a restrictor slot in the second side plate of the base; and a first rod lock forcer oriented between the first rod travel limiter and the exterior side of the first side plate of the base, wherein the first rod lock forcer must be overcome with a lateral force to allow the retainer arm restrictor to be clear of the restrictor slot to permit a rotation of the retainer arm.

6. The latching system of claim 5, further comprising:

an alignment bracket extending from the base bracket of the base, the alignment bracket having a fifth hole through which the thin rod portion of the second rod can traverse through and rotate within.

7. A method comprising:

mounting a base of a latch to a first surface, wherein the base is composed of:

a base bracket composed of:

a first base plate;

a first side plate and a second side plate extending away from the first base plate, the first side plate having a first hole and a second hole, and the second side plate having a third hole and a fourth hole;

a first rod that includes:

a retainer arm extending non-linearly away from the first rod, the first rod rotatably extending through the first hole in the first side plate of the bracket and the third hole in the second side plate of the base bracket, and the retainer arm being oriented by an external surface of the second side plate of the base bracket;

a second rod that includes:

a thin rod portion that has a first diameter;

a thick rod portion that is linear with the thin rod portion, the thick rod portion having a second diameter that is greater than the first diameter of the thin rod portion, wherein the thin rod portion is extensible through the fourth hole in the second side plate, and the thick rod portion is extensible through the second hole of the first side plate; and a knob that is attached to the thick rod portion of the second rod;

mounting a mating bracket of the latch to a second surface, wherein the mating bracket is composed of:

a second base plate;

a first slot plate and a second slot plate extending away from the second base plate, the first and second slot plates each having a first slot and a second slot, wherein the first slot has a first slot width and the second slot has a second slot width; and aligning the base with the mating bracket such that the first slots each have a first throat width that is wide enough to permit the first rod to mate with the first slots, wherein the second slots have a second throat width that is narrow enough to permit only the thin rod portion of the second rod to mate with the second slots in the mating bracket while preventing the thick rod portion from mating with the second slot in the mating bracket.

8. The method of claim 7, wherein if the second rod's thick rod portion is oriented with the second slot of the second slot plate of the mating bracket in an orientation that prevents the second rod's thick rod portion from mating with the second slot of the second slot plate of the mating bracket then the second rod's thin rod portion extends past the exterior surface of the base bracket's second side plate, wherein the retainer arm of the first rod is prevented from rotating past the second rod's thin rod portion, and wherein an object positioned on the first surface is prevented by the retainer arm from sliding to the second surface.

9. The method of claim 8, wherein the second rod has a second rod lock forcer that forces the second rod to be in a non-aligned position away from an exterior surface of the base bracket's first side plate, such that the second slot is unable to mate with the second rod and the retainer arm is prevented from rotating past the second rod's thin rod portion.

10. The method of claim 9, wherein the first rod has a first rod travel limiter on a first end of the first rod that is opposite a second end to which the retainer arm is attached, the first rod travel limiter being oriented against an exterior side of the first side plate of the base and the first rod travel limiter having a greater diameter than the first hole in the first side plate of the bracket, wherein the first rod is prevented from sliding through the third hole in the second side plate to a distance that permits the retainer arm to rotate past the thin rod portion when the second rod is in the non-aligned portion.

11. The method of claim 10, wherein the retainer arm has a retainer arm restrictor attached to the retainer arm and the first rod, and wherein the second side plate of the base has a restrictor slot, and wherein the first rod has a first rod lock forcer oriented between the first rod travel limiter and the exterior side of the first side plate of the base, wherein the first rod lock forcer must be overcome with a lateral force to allow the retainer arm restrictor to be clear of the restrictor slot to permit a rotation of the retainer arm.

12. The method of claim 11, wherein the base bracket has an alignment bracket extending from the base bracket of the base, the alignment bracket having a fifth hole through which the thin rod portion of the second rod can traverse through and rotate within.

13. A system comprising:

a pallet, the pallet having an attached base that is composed of:

a base bracket composed of:

a first base plate;

a first side plate and a second side plate extending away from the first base plate, the first side plate having a first hole and a second hole, and the second side plate having a third hole and a fourth hole;

a first rod that includes:

a retainer arm extending non-linearly away from the first rod, the first rod rotatably extending through the first hole in the first side plate of the bracket and the third hole in the second side plate of the base bracket, and the retainer arm being oriented by an external surface of the second side plate of the base bracket;

a second rod that includes:

a thin rod portion that has a first diameter;

a thick rod portion that is linear with the thin rod portion, the thick rod portion having a second diameter that is greater than the first diameter of the thin rod portion, wherein the thin rod portion is extensible through the fourth hole in the second side plate, and the thick rod portion is extensible through the second hole of the first side plate; and a knob that is attached to the thick rod portion of the second rod; and a ramp that has an attached mating bracket that is composed of:

a second base plate;

a first slot plate and a second slot plate extending away from the second base plate, the first and second slot plates each having a first slot and a second slot, wherein the first slot has a first slot width and the second slot has a second slot width;

wherein the first slots each have a first throat width that is wide enough to permit the first rod to mate with the first slots, and wherein the second slots have a second throat width that is narrow enough to permit only the thin rod portion of the second rod to mate with the second slots in the mating bracket while preventing the thick rod portion from mating with the second slot in the mating bracket.

14. The system of claim 13, wherein if the second rod's thick rod portion is oriented with the second slot of the second slot plate of the mating bracket in an orientation that prevents the second rod's thick rod portion from matins with the second slot of the second slot plate of the mating bracket, then the second rod's thin rod portion extends past the exterior surface of the base bracket's second side plate, wherein the retainer arm of the first rod is prevented from rotating past the second rod's thin rod portion, wherein an object positioned on the pallet is prevented by the retainer arm from sliding to the ramp.

15. The system of claim 14, further comprising:

a second rod lock forcer that forces the second rod to be in a non-aligned position away from an exterior surface of the base bracket's first side plate, such that the second slot is unable to mate with the second rod and the retainer arm is prevented from rotating past the second rod's thin rod portion.

16. The system of claim 15, further comprising:

a first rod travel limiter on a first end of the first rod that is opposite a second end to which the retainer arm is attached, the first rod travel limiter being oriented against an exterior side of the first side plate of the base and the first rod travel limiter having a greater diameter than the first hole in the first side plate of the bracket, wherein the first rod is prevented from sliding through the third hole in the second side plate to a distance that permits the retainer arm to rotate past the thin rod portion when the second rod is in the non-aligned portion.

17. The system of claim 16, further comprising:

a retainer arm restrictor attached to the retainer arm and the first rod;

a restrictor slot in the second side plate of the base; and a first rod lock forcer oriented between the first rod travel limiter and the exterior side of the first side plate of the base, wherein the first rod lock forcer must be overcome with a lateral force to allow the retainer arm restrictor to be clear of the restrictor slot to permit a rotation of the retainer arm.

18. The system of claim 17, further comprising:

an alignment bracket extending from the base bracket of the base, the alignment bracket having a fifth hole through which the thin rod portion of the second rod can traverse through and rotate within.

* * * * *